United States Patent [19]

Itakura

[11] Patent Number: 4,726,324

[45] Date of Patent: Feb. 23, 1988

[54] COOLING SYSTEM CONTROLLER FOR INTERNAL COMBUSTION ENGINES

[75] Inventor: Masato Itakura, Toyota, Japan

[73] Assignee: Aisin Seiki Kabushiki Kaisha, Kariya, Japan

[21] Appl. No.: 31,578

[22] Filed: Mar. 30, 1987

[30] Foreign Application Priority Data

Mar. 28, 1986 [JP] Japan ..... 61-70182

[51] Int. Cl.[4] ..... F01P 3/20

[52] U.S. Cl. ..... 123/41.1; 123/41.29; 123/41.82 R

[58] Field of Search ..... 123/41.1, 41.29, 41.44, 123/41.49, 41.51, 41.82 R

[56] References Cited

U.S. PATENT DOCUMENTS

| | | | |
|---|---|---|---|
| 3,964,449 | 6/1976 | Thien et al. | 123/41.51 |
| 4,061,187 | 12/1977 | Rajasekaran et al. | 123/41.29 |
| 4,186,693 | 2/1980 | Thien et al. | 123/41.51 |
| 4,369,738 | 1/1983 | Hirayama | 123/41.29 |
| 4,370,950 | 2/1983 | Furukubo | 123/41.29 |
| 4,381,736 | 5/1983 | Hirayama | 123/41.29 |
| 4,413,596 | 11/1983 | Hirayama | 123/41.29 |
| 4,423,705 | 1/1984 | Morita et al. | 123/41.29 |
| 4,449,486 | 5/1984 | Kin | 123/41.29 |
| 4,539,942 | 9/1985 | Kobayashi et al. | 123/41.29 |

FOREIGN PATENT DOCUMENTS 2112922 7/1983 United Kingdom ..... 123/41.51

*Primary Examiner*—William A. Cuchlinski, Jr.
*Attorney, Agent, or Firm*—Oblon, Fisher, Spivak, McClelland & Maier

[57] ABSTRACT

A cooling systems controller for internal combustion engines having two circuits of cooling water for cylinder head side and cylinder block side, each of two circuits being provided with a radiator, a water jacket, a water pump, a conduit, a return passageway, a bypass passageway, a mixing valve, and a motor fan; two heater circuits being provided so as to branch from and return to said main two cooling water circuits, said heater circuits being provided with a first selector valve to junction them and a second selector valve to separate them, said selector valve having a function to supply the higher temperature water from either of two water circuits to a heater radiator by the signals from a control unit for judging which temperature of two circuits is higher, thereby making it possible to obtain more rapid heating effect at the time immediately after starting up the engine without reducing the heating efficiency during normal runs of vehicle.

1 Claim, 2 Drawing Figures

COOLING SYSTEM CONTROLLER FOR INTERNAL COMBUSTION ENGINES

BACKGROUND OF THE INVENTION

1. Field of the Invention

This invention relates to a cooling system controller for internal combustion engines.

2. Prior Art

It is a daily experience matter that the heating efficiency of a heater is not high at the time immediately after starting up the engine of vehicles. This is because, as stated in the Japanese Laid-open Utility Model Bulletin Jitsu-kai-sho No. 59-139516 (139516/1984), conventional heaters for vehicles use the engine cooling water as the heat source, and consequently, the heater does not supply warmed air until the time when the temperature of cooling water becomes fully high. Namely, the warm-up character of engine has a great influence on the efficiency of heater.

A device which intends to improve the efficiency of heater is disclosed in the Japanese Laid-open Patent Bulletin Toku-kai-sho No. 60-19912. The above improvement relates to a heater for an engine having two separated cooling water circuits, that is, a circuit including a water jacket provided at the cylinder-head side and a circuit including a water jacket provided at the cylinder-block side. In the conventional heaters such as mentioned in the above literature, the heater circuit is by-passed from the cylinder-block side circuit, this is because, in the two-circuits cooling system, the temperature at the head side is generally maintained lower than the temperature at the block side. But, at the time immediately after starting up the engine, the rise of temperature is more rapid at the head side than at the block side, as the head side is positioned more closely to the combustion chamber which is the main heat-generating portion. Therefore, as far as concerned with the heating effect, the conventional heater of aforementioned type is disadvantageous. Incidentally, the heating effects can be improved by combining the bypass valve disclosed in the prior art of said Jitsu-kai-sho No. 59-139516 with the bypass in the circuit on the block side disclosed in another prior art of said Toku-kai-sho No. 60-19912. By this way, the flow rate of the heater circuit can be increased and the heat radiating efficiency of the heater radiator can be improved by closing the bypass. But the amount of heat radiated from the heater cannot be greater than the amount of heat the cooling water receives from the heat generating section. It is also clear that the water on the heat side is at a higher temperature because the greatest portion of the heat generated immediately after start-up is from around the combustion chamber. Thus, the above improvement cannot but be disadvantageous.

SUMMARY OF THE INVENTION

The object of the present invention is to provide an improved controller for the two-circuits cooling system, which can avoid the drawback of the conventional system that the good heating effect is not obtained at the time immediately after starting up the engine, namely, to provide a controller which has the improved heating effect at the time immediately after starting up the engine, without reducing the efficiency of heater radiator at the time of normal running.

In accordance with the present invention, the cooling system has the first and second water jackets, the first and second water pumps, the first and second conduits, the first and second return passageways, the first and second by-pass passageways, the first and second mixing valves, the first and second radiators, and the first and second motor fans. At the downstream side outlet ports of said first and second jackets, the first and second heater circuits are branched respectively. Said first and second heater circuits are junctioned by the first selector valve disposed at the upperstream of the heater radiator, are separated by the second selector valve disposed at the downstream of said heater radiator, and returns to a main water circuit respectively at the upperstream of said first or second water pump and at the downstream of said first or second mixing valve. Said first and second selector valves have the function to feed water of higher temperature out of water in said first or second water jacket or to shut off both water flows, in accordance with the signal from a control unit having function to detect the temperature at the outlet port of the downstream of said first and second water jackets by a sensor and to compare them.

When the heater is unnecessary, both of the first and second selector valves are closed and water does not flow in the heater circuit. When the heater is necessary, the control unit judges either temperature of the temperatures at the cylinder head side and the cylinder block side, and controls the opening and closing of the first and second selector valves so that the water having higher temperature is fed to the heater circuit. Namely, the selector valves opens the cylinder head side at the time immediately after staring up the engine, as the temperature at the cylinder head side closer to the combustion chamber rises more rapidly. When the temperature at the cylinder block side becomes higher than the temperature at the cylinder head side, the selector valves close the cylinder head side and open the cylinder block side. Thus, by the present invention, it is possible to make the heater operation effective in the time immediately after start-up the engine without degrading the efficiency of heat radiator during normal run.

The foregoing and other objects, features and advantages of the present invention will be understood more clearly and fully from the following detailed description of preferred embodiments with reference to the attached drawings.

DETAILED DESCRIPTION OF PREFERRED EMBODIMENT

Figure 1:
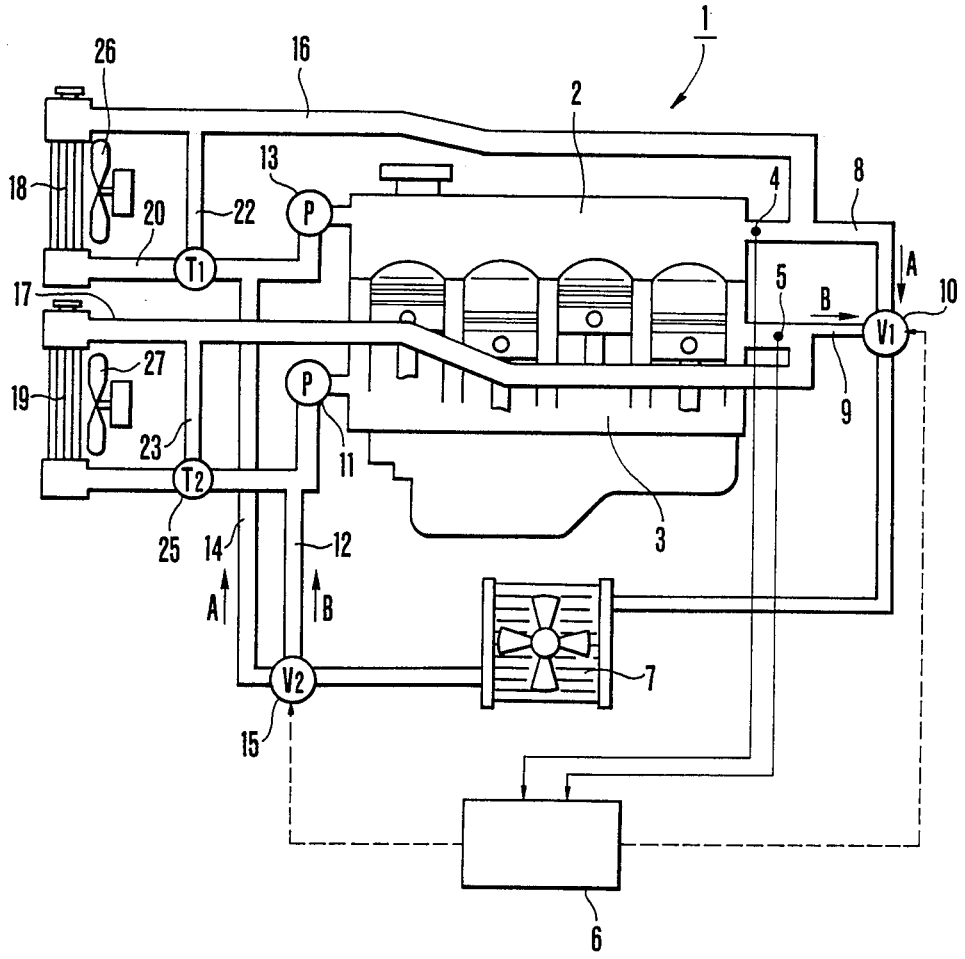
FIG. 1 shows the outline of the cooling system of one embodiment in accordance with the present invention.
Figure 2:
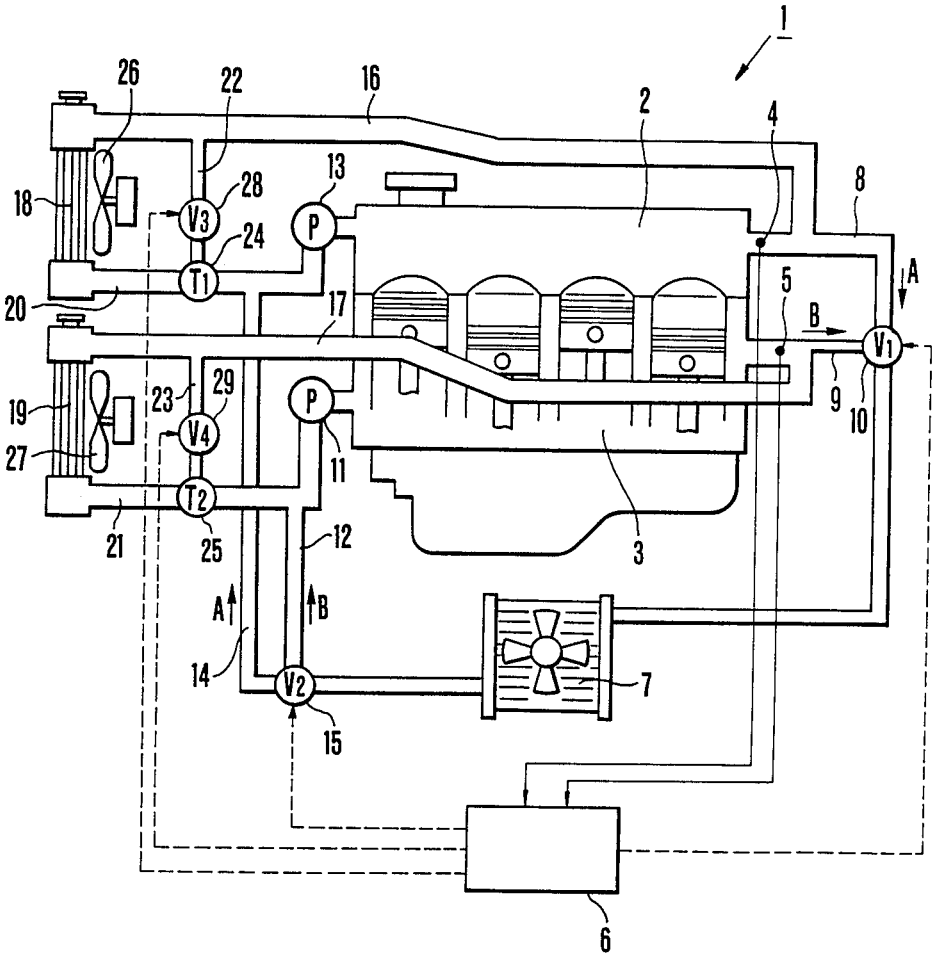
FIG. 2 shows the outline of the cooling system of another embodiment in accordance with the present inven- tion.

Referring to FIG. 1 and FIG. 2, there is shown an embodiment of the present invention. In a cooling system controller 1 for the internal combustion engines, the first and second heater circuits 8 and 9 are led from the outlet port of the first water jacket 2 on the head side and the outlet port of the second water jacket 3 on the block side respectively to combine them together; the first selector valve 10 is disposed at the junction, a heater radiator 7 is disposed downstream of the valve; the water stream is further diverted to circuit 12 which leads the stream to upstream of the second water pump 11 on the block side and circuit 14 which leads the stream to upstream of the first water pump 13 on the head side; the second selector valve 15 is disposed at the point of diversion, and said first selector valve 10 is able to shut off the water coming from both the block side and the head side and has the function of supplying either of the water selectively to heater radiator 7 (A side closed, B side closed: A side open, B side closed: A side closed, B side open).

A second selector valve 15, interlocked with the first selector valve 10, has the function of returning the water which has passed through the heater radiator 7, to the original water circuit. Also temperature sensors 4 and 5 are provided at the outlet port on the head side and the outlet port on the block side respectively so as to send their signals to control unit 6. The first and second conduits 16 and 17 connect the outlet ports of water jackets 2 and 3 and the inlet ports of the first and second radiators 18 and 19 respectively. The return passageways 20 and 21 connect the outlet ports of the first and second radiators 18 and 19 and the first and second water pumps 13 and 11 respectively. The first and second bypass passageways 22 and 23 branch from the first and second conduits 16 and 17 and communicate with the first and second return passageways 20 and 21 respectively. The first and second mixing valves 24 and 25 are located at the junction of the first and second return passageways and the first and second bypass passageways 22 and 23 and mix the cooling water from each passageway to return it to the first and second water pumps 13 and 11. The first and second motor fans 26 and 27 feed cooling air to the first and second radiators 18 and 19 respectively.

The first water jacket 2 on the head side and the second water jacket 3 on the block side have the same temperature at the time immediately after start-up of the engine. Then, at the beginning stage when the engine is warmed up by repeating combustion, the main heat generating portion is the combustion chamber, and the temperature rises more rapidly at the first water jacket 2 on the head side. If the heater is switched on at this time, control unit 6 compares the signals from the temperature sensors 4 and 5, judges that the temperature of the water on the head side is higher, and opens the first and second selector valves 10 and 15 to the head side (A side).

When the engine is sufficiently warmed up, the water on the head side is maintained at a lower temperature than on the block side by the action of the first and second mixing valves 24 and 25. In the process to this stage, the magnitude of signals of the temperature sensors 4 and 5 are reversed and the water stream is changed over so that the water on the block side (B side) flows to heater radiator 7 thereafter. When the heater is switched off, the first and second selector valves 10 and 15 are closed both on the head side and the block side. Thus, the heater works more rapidly in the time immediately after start-up because of the heat being radiated from the higher temperature water on the head side, while the heat radiation efficiency becomes high in the normal running state.

FIG. 2 shows a second embodiment, which is a system to increase the heater flow rate by providing the first and second shut-off valves 28 and 29 for shutting off the flow in the bypass passageways only during the warmup time of the engine, in the first and second bypass passageways 22 and 23. The function and effect of this system is same as in the aforementioned first embodiment. The same effect can be achieved by a system in which the first and second selector valves 10 and 15 change over only the A side and the B side and another ON-OFF valve or a throttle valve is provided at the position between the confluence of the first and second selector valves 10 and 15 and the point of diversion.

It should be understood that, although the preferred embodiment of the present invention has been described herein in considerable detail, certain modifications, changes, and adaptations may be made by those skilled in the art and that it is hereby intended to cover all modifications, changes and adaptations thereof falling within the scope of the appended claims.

What is claimed is:

1. A cooling system controller for internal combustion engines comprising:

a first radiator and a second radiator, a first water jacket provided to a cylinder head, a second water jacket provided to a cylinder block, a first water pump and a second water pump, being provided respectively at the upperstream side of said first or second water jacket, a first and second conduits, connecting respectively an outlet port at the downstream side of said first or second water jacket to an inlet port of said first or second radiator, a first return passageway and a second return passageway, connecting respectively an outlet port of said first or second radiator to said first or second water pump, a first bypass passageway and a second bypass passageway, being branched respectively from said first or second conduit and communicating respectively with said first or second return passageway, a first mixing valve and a second mixing valve, being disposed respectively at the junction of said first or second bypass passageway and said first or second return passageway, to mix cooling water of the two passageways and return it to said first or second water pump respectively, a first motor fan and a second motor fan, to supply cooling water respectively to said first or second radiator, a first heater circuit and second heater circuit, being branched out respectively at the outlet port of the downstream side of said first or second water jacket, said first and second heater circuits being junctioned by a first selector valve at the upperstream of a heater radiator, being separated by a second selector valve at the downstream of said heater radiator, and returning respectively to a main water circuit at a position which is on the upperstream of said first or second water pump and on the downstream of said first or second mixing valve, and said first and second selector valves having the function to supply water of the higher temperature from either of said first and second water jackets to said heater radiator by the signals from a control unit which detects the temperature at the downstream side outlet ports of said first and second water jackets and compares them, and having the function to shut off both water flows.

* * * * *